United States Patent [19]

Carlson et al.

[11] 4,009,031

[45] Feb. 22, 1977

[54] DIFFUSION TRANSFER IMAGE-RECEIVING ELEMENT HAVING POLYVINYLPYRIDINE LAYER TREATED WITH HYDROPHILIC COLLOID/AMMONIA SOLUTION

[75] Inventors: David P. Carlson, Westboro; Thomas R. Keenan, Reading; Douglas L. Marks, Burlington, all of Mass.

[73] Assignee: Polaroid Corporation, Cambridge, Mass.

[22] Filed: June 6, 1975

[21] Appl. No.: 584,488

Related U.S. Application Data

[63] Continuation-in-part of Ser. No. 420,134, Nov. 29, 1973, abandoned.

[52] U.S. Cl. ..... 96/29 D; 96/3; 96/77; 96/119 R; 427/333; 427/407 C; 428/500

[51] Int. Cl.[2] ..... G03C 5/54; G03C 7/00; G03C 1/40; B44D 1/09

[58] Field of Search ..... 96/3, 29 D, 77, 119 R; 428/497, 500; 427/333, 407

[56] References Cited

UNITED STATES PATENTS

| | | | |
|---|---|---|---|
| 2,759,825 | 8/1956 | Land | 96/29 D |
| 3,148,061 | 9/1964 | Haas | 96/3 |
| 3,295,970 | 1/1967 | Rogers | 96/3 |
| 3,325,283 | 6/1967 | Barstow et al. | 96/3 |
| 3,388,994 | 6/1968 | Young | 96/3 |
| 3,698,896 | 10/1972 | Abbott | 96/3 |

*Primary Examiner*—David Klein
*Assistant Examiner*—Richard L. Schilling
*Attorney, Agent, or Firm*—Mart C. Matthews; Philip G. Kiely

[57] ABSTRACT

Coating a solution comprising a hydrophilic colloid and ammonia over a receiving layer comprising polyvinylpyridine in an image-receiving element of a photographic film unit significantly reduces haze and facilitates the separation of the image-receiving element from the remainder of the film unit subsequent to diffusion transfer processing.

17 Claims, 1 Drawing Figure

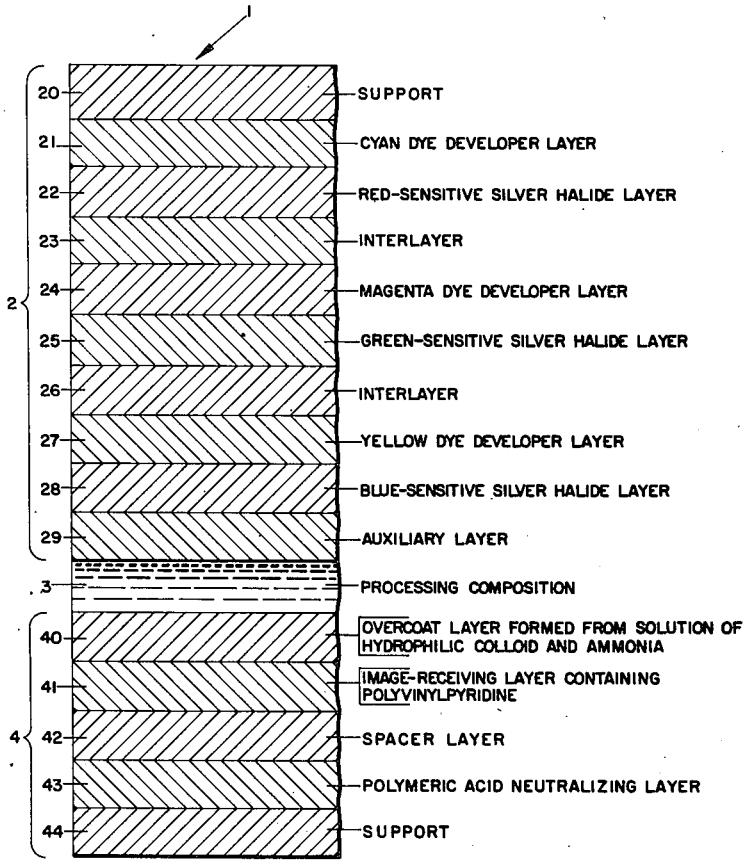

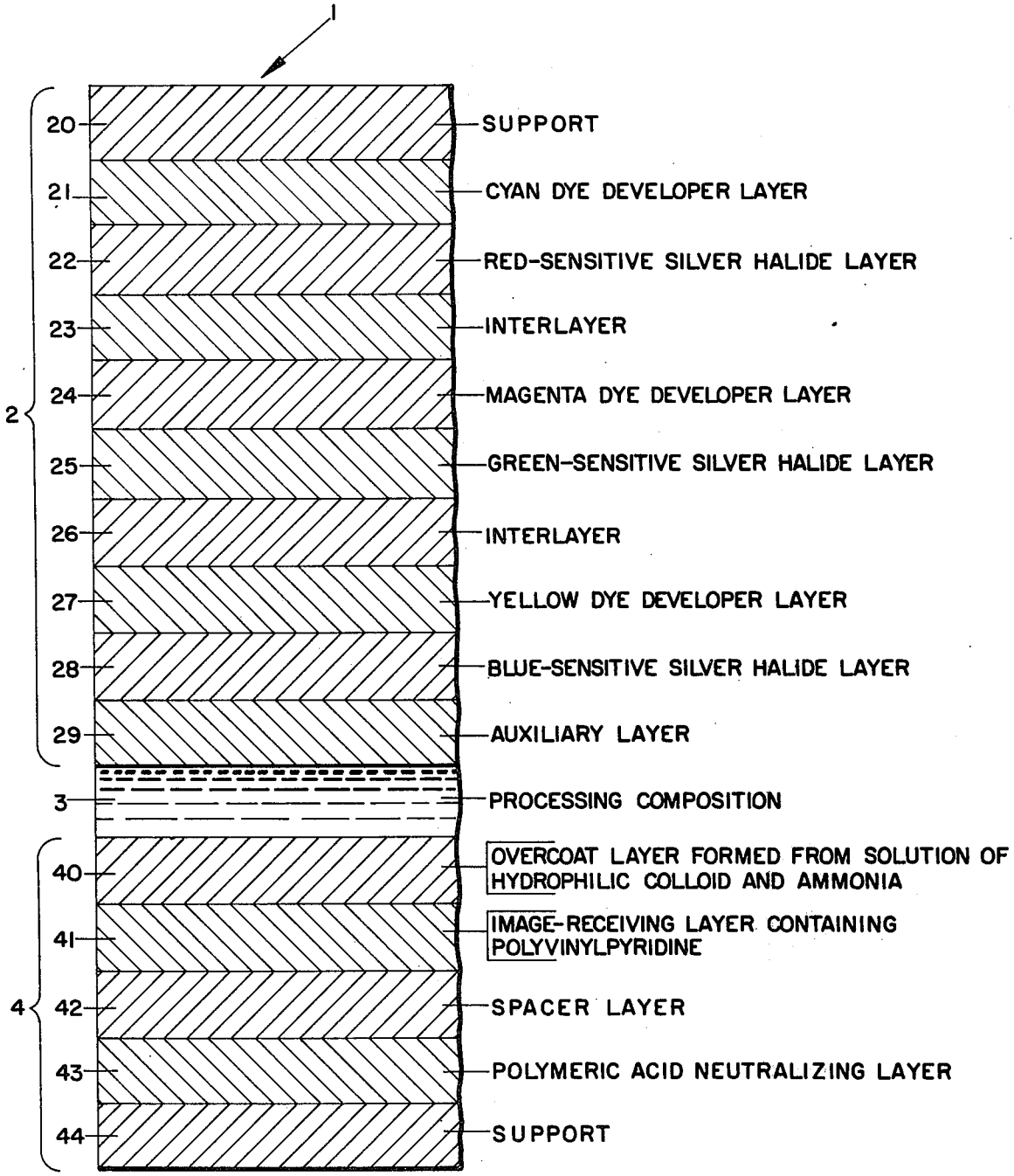
1
2
20
21
22
23
24
25
26
27
28
29
3
4
40
41
42
43
44
SUPPORT
CYAN DYE DEVELOPER LAYER
RED-SENSITIVE SILVER HALIDE LAYER
INTERLAYER
MAGENTA DYE DEVELOPER LAYER
GREEN-SENSITIVE SILVER HALIDE LAYER
INTERLAYER
YELLOW DYE DEVELOPER LAYER
BLUE-SENSITIVE SILVER HALIDE LAYER
AUXILIARY LAYER
PROCESSING COMPOSITION
OVERCOAT LAYER FORMED FROM SOLUTION OF HYDROPHILIC COLLOID AND AMMONIA
IMAGE-RECEIVING LAYER CONTAINING POLYVINYLPYRIDINE
SPACER LAYER
POLYMERIC ACID NEUTRALIZING LAYER
SUPPORT

DIFFUSION TRANSFER IMAGE-RECEIVING ELEMENT HAVING POLYVINYLPYRIDINE LAYER TREATED WITH HYDROPHILIC COLLOID/AMMONIA SOLUTION

CROSS-REFERENCE TO RELATED APPLICATION

This application is a continuation-in-part of copending application Ser. No. 420,134, filed Nov. 29, 1973, now abandoned.

BACKGROUND OF THE INVENTION

Various diffusion transfer systems for forming color images have heretofore been disclosed in the art and need not be described in detail in this application. Generally speaking, such systems rely for color image formation upon a differential in mobility or solubility or a dye image-providing material obtained as a function of development of exposed silver halide so as to provide an imagewise distribution of such material which is more diffusible and which is therefore selectively transferred, at least in part, by diffusion, to a superposed dyeable stratum to impart thereto the desired color transfer image. The differential in mobility or solubility may, for example, be obtained by a chemical action such as a redox reaction or a coupling reaction.

In any of these systems, multicolor images are obtained by employing a film unit containing at least two selectively sensitized silver halide emulsions each having associated therewith a dye image-providing material exhibiting desired spectral absorption characteristics. The most commonly employed elements of this type are the so-called tripack structures employing a blue-, a green- and a red-sensitive silver halide layer having associated therewith, respectively, a yellow, a magenta and a cyan dye image-providing material.

A particularly useful system for forming color images by diffusion transfer is that descrived in U.S. Pat. No. 2,983,606, employing dye developers (dyes which are also silver halide developing agents) as the dye image-providing materials. In such systems, a photosensitive element comprising at least one silver halide layer having a dye developer associated therewith (in the same or in an adjacent layer) is developed by applying an aqueous alkaline processing composition. Exposed and developable silver halide is developed by the dye developer which in turn becomes oxidized to provide an oxidation product which is appreciably less diffusible than the unoxidized dye developer, thereby providing an imagewise distribution of diffusible dye developer in terms of unexposed areas of the silver halide layer, which imagewise distribution is then transferred, at least in part, by diffusion to an image-receiving stratum layer to impart thereto a positive dye transfer image. Multicolor images may be obtained with a photosensitive element having two or more selectively sensitized silver halide emullsions and associated dye developers. A tripack structure of the type described above and in various patents including the aforementioned U.S. Pat. No. 2,983,606 is especially suitable for accurate color recordation of the original subject matter.

The resulting image may be revealed by separation of the image-receiving element from the photosensitive element subsequent ot processing, although processes are heretofore known wherein the aforementioned elements are retained in superposition and the image is viewed through a transparent support; for example, as described in Land U.S. Pat. Nos. 3,415,644; 3,415,645; and 3,415,646. Of course, when the image-receiving element is stripped from the remainder off the film unit, the processing composition should not stick to the image-receiving layer in sizable amounts. However, in many instances when thickening agents such as a hydroxyalkyl cellulose either, e.g. hydroxyethyl cellulose, are used in the processing compositions in sufficient concentrations to produce processing compositions of a desired high viscosity, the composition has been found to adhere to an undesirable degree to the receiving element.

Image-receiving elements employed in diffusion transfer color processes typically comprise a plurality of layers coated on one surface of a support, including at least an image-receiving layer adapter to provide a visible image upon transfer to said layer of the diffusible dye image-providing material. Haas U.S. Pat. No. 3,148,061 issued Sept. 8, 1964, discloses image-receiving layers composed of polymers of 4-vinylpyridine which are particularly useful in diffusion transfer processes employing dye developers. As disclosed in Young U.S. Pat. No. 3,388,994 issued June 18, 1968, treatment of the poly-4-vinylpyridine image-receiving layer with ammonia after drying increases the gloss and reduces haze, thereby substantially improving the optical quality of these poly-4-vinylpyridine image-receiving layers.

In addition to the image-receiving layer, the above-described image-receiving elements may further comprise a polymeric acid layer and inert spacer layer, for example, as described in Land U.S. Pat. No. 3,362,819 issued Jan. 9, 1968. The prior art contains several references to diffusion transfer image-receiving elements which also include an external or overcoat layer comprising a hydrophilic colloid to accomplish various purposes. See, for example, Land U.S. Pat. No. 2,759,825 issued Aug. 21, 1956 and Barstow et al, U.S. Pat. No. 3,325,283 issued June 13, 1967, (overcoats to facilitate stripping of the elements); Rogers U.S. Pat. No. 3,295,970 issued Jan. 3, 1967 (an overcoat to increase stability of image to light); and Abbott U.S. Pat. No. 3,698,896 issued Oct. 17, 1972 (an overcoat to provide higher dye densities in color coupler processes). The overcoat layer of the present invention provides an image-receiving element with significantly less haze than those of the prior art as well as providing an efficacious separation of the image-receiving element from the processing composition subsequent to diffusion transfer processing.

SUMMARY OF THE INVENTION

It has been found in accordance with this invention that improved image-receiving elements for dye developer diffusion transfer processes are provided by coating an aqueous solution comprising a hydrophilic colloid and ammonia over an image-receiving layer comprising polyvinylpyridine. A reduction in haze is effected by the present invention which is substantially greater than that obtained by treating the image-receiving layer with ammonia alone, or by coating the image-receiving layer with a hydrophilic colloid layer without the ammonia treatment. It has also been found that the overcoat layer formed facilitates separation of the image-receiving element from contact with the diffusion transfer processing composition subsequent to diffusion transfer processing, in products and processes wherein this separation is necessary to reveal the transfer image.

BRIEF DESCRIPTION OF THE DRAWING

For a fuller understanding of the nature and objects of the invention, reference should be had to the following detailed description taken in connection with the accompanying drawing, which is a diagrammatic enlarged cross-sectional view illustrating the association of elements during one stage of the performance of a diffusion transfer process for the production of a multicolor positive transfer print, the thickness of the various layers being exaggerated.

DESCRIPTION OF THE PREFERRED EMBODIMENT

The image-receiving elements of the present invention comprise a support having coated on one surface thereof, an image-receiving layer comprising a polymer of vinylpyridine, preferably 4-vinylpyridine, over which has been coated an aqueous solution comprising a hydrophilic colloid and ammonia. In general, the image-receiving elements may be prepared by coating techniques commonly employed in the art. Accordingly, the novel image-receiving elements within this invention may be prepared by coating a sheet of a suitable film support such as, for example, cellulose acetate, cellulose nitrate or cellulose acetate-coated baryta paper, which may be suitably subcoated for proper adhesion, with an acidic solution comprising the polyvinylpyridine or a mixture of, for example, poly-4-vinylpyridine and polyvinyl alcohol. This layer may then be dried with heat, for example, at a temperature of about 200° F., to form a stable image-receiving layer. Thereafter, the image-receiving layer may be contacted with ammonia, either as ammonia fumes or a dilute solution of ammonium hydroxide, and subsequent to drying the so-treated receiving layer briefly with heat, e.g., about 30–40 secs. at about 200° F., a thin layer of a hydrophilic colloid may be applied thereover and similarly dried. In a more preferable embodiment, an aqueous solution comprising both the hydrophilic colloid and ammonia may be applied and dried directly over the dried image-receiving layer. It is to be understood that the term "ammonia" as used herein, including the appended claims, is intended to denote any source of ammonia, $NH_3$, which includes ammonium hydroxide, or other ammonia compounds capable of generating ammonia in situ. Other layers may also be coated on the support, for example, as shown in the accompanying drawing and described in detail hereinafter.

As described in the aforementioned Haas U.S. Pat. No. 3,148,061, image-receiving layers comprising polyvinylpyridine are prone to developing a haziness which has been hypothesized as resulting from light diffraction effects produced by the retention as a polyvinylpyridinium sald of the acid customarily employed to dissolve the polyvinylpyridine polymers for coating. Treatment of the image-receiving layer with ammonia is disclosed therein as being effective in reducing this haziness. It has been quite unexpectedly discovered in accordance with this invention that the application of a hydrophilic colloid ammonia solution over the image-receiving layer provides substantially greater reductions in haze than the ammonia treatment alone. Furthermore, the layer thus formed was found to be useful as a "strip coat" on the external surface of the image-receiving element which significantly facilitated separation of the element from the remainder of the film unit subsequent to processing.

The term "polyvinylpyridine" as used herein refers to polymers comprising a major portion of segments derived from a vinylpyridine monomer, e.g., 2-vinylpyridine or 4-vinylpyridine, and particularly to homopolymers of 4-vinylpyridine. As will be described in more detail later, preferred image-receiving layer comprise a mixture of the poly-4-vinylpyridine and, for example, polyvinyll alcohol.

The above-mentioned preferred solution comprising a hydrophilic colloid and ammonia may be coated from an aqueous coating solution prepared by diluting concentrated ammonium hydroxide (about 28.7% $NH_3$) with water to the desired concentration, preferably from about 2% to about 8% by weight, and then adding to this solution an aqueous hydrophilic colloid solution having a total solids concentration in the range of about 1% to about5% by weight. The coating solution also preferably may include a small amount of a surfactant, for example, less than about 0.10% by weight of Triton X-100 (Rohm and Haas Co., Phila., Pa.). A preferred solution comprises about 3 parts by weight of ammonium hydroxide and about 2 parts by weight of gum arabic.

The thickness of the resultant overcoat layer of this invention may vary, and is preferably quite thin, i.e., from about 0.01 to 0.05 mils. It is apparent that the overcoat layer should not contain a mordant for the diffusing dye developer and should not be so thick as to serve as an image-receiving layer itself, or interfere with the transfer of dye developer to the underlying image-receiving layer. Generally, a hydrophilic colloid layer having a coverage from about 5 mgs. to about 100 mgs. of total solids per square foot will provide effective results. Sufficient ammonia should be present in the hydrophilic colloid solution to provide maximum reduction of haze in the image-receiving layer. Especially good results have been obtained using a solution comprising about 3 parts by weight of ammonium hydroxide and about 2 parts by weight of gum arabic, which solution is applied to the dried image-receiving layer at a total solids coverage of about 25 mgs. per square foot. A significant amount of free ammonia may not be present in the resultant dried overcoat layer. The ammonia of the solution coated over the image-receving layer may either form a salt with an acid, e.g., the acetic or lactic acid in the image-receiving layer, or may volatilize off.

A wide variety of hydrophilic colloids are contemplated as being suitable for forming the overcoat layer of the present invention. Preferred hydrophilic colloids are those providing effective "strip coats" for diffusion transfer image-receiving elements which require separation, subsequent to formation of a transfer image from the viscous processing composition. As specific examples of such hydrophilic colloids, mention may be made of gum arabic, polyethylene glycol, carboxymethyl cellulose, hydroxyethyl cellulose, carboxymethyl hydroxyethyl cellulose, cellulose acetate-hydrogen phthalate, polyvinyl alcohol, polyvinyl pyrrolidone, methyl cellulose, ethyl cellulose, cellulose nitrate, sodium alginate, pectin, polymethacrylic acid, polymerized salts of alkyl, aryl and alkyl sulfonic acids (e.g., Daxad, W.R. Grace Co.), and the like.

Preferably, the image-receiving layer comprises a mixture of poly-4-vinylpyridine and polyvinyl alcohol, generally in a weight ratio of from 1 to 9 parts of polyvinyl alcohol to 1 part of poly-4-vinylpyridine. Especially good results are obtained when the weight ratio of polyvinyl alcohol to poly-4-vinylpyridine is about 2:1. The thickness of the image-receiving layer preferably ranges from about 0.20 to about 0.45 mils. The receiving layer may also contain, if desired, additives such as other dye mordants in addition to the poly-4-vinylpyridine, ultra-violet absorbers, pH-reducing substances, and other specific reagents performing desired functions, e.g., a developer restrainer, as disclosed for example, in U.S. Pat. No. 3,265,498. A cross-linking agent, for example, as described in U.S. Pat. Nos. 3,033,872 and 3,586,503, may also be present to harden the image-receiving layer and reduce its water sensitivity.

The present invention is applicable to a wide variety of color diffusion transfer processes and the arrangement and order of the individual layers of the film unit used in such processes may vary in many ways as is known in the art. For convenience, however, the more specific description of the invention may be by use of the preferred dye developer diffusion transfer color processes and film units without limitation of the invention to the preferred structure denoted.

Specifically, with reference to the drawing, the image-receiving element may comprise a plurality of layers coated on a polymeric support 44 including a polymeric acid neutralizing layer 43, a polymeric spacer layer 42, an image-receiving layer 41 containing polyvinylpyridine and an overcoat layer 40 formed from the solution of a hydrophilic colloid and ammonia in accordance with the invention. The image-receiving element is shown in the drawing in processing relationship with a multilayer photosensitive element 2 and aqueous alkaline processing composition 3.

The multicolor, multilayer photosensitive element 2 may comprise a support 20 carrying a red-sensitive silver halide emulsion layer 22, a green-sensitive silver halide emulsion layer 25 and a blue-sensitive silver halide emulsion layer 28. In turn, the emulsion layers may have positioned behind them and contained in layers 21, 24 and 27, respectively, a cyan dye developer, a magenta dye developer and a yellow dye developer. Interlayers 26 and 23 may be respectively positioned between the yellow dye developer layer and the green-sensitive emulsion layer, and between the magenta dye developer layer and the red-sensitive emulsion layer. An auxiliary layer 29 may also be included as the outermost surface of the photosensitive element.

In the performance of a diffusion transfer multi-color process employing film unit 1, the unit is exposed to radiation actinic to photosensitive element 2.

Subsequent to exposure, film unit 1 may be processed by being passed through two opposed suitably gapped rolls in order to apply compressive pressure to a frangible container affixed to the leading edge of one of the elements thereby effecting rupture of the container and distribution of alkaline processing composition 3 (having a pH at which the cyan, magenta and yellow dye developers are soluble and diffusible) intermediate the overcoat layer 40 of the image-receiving element and auxiliary layer 29 of the photosensitive element.

Alkaline processing solution 3 permeates emulsion layers 22, 25 and 28 to initiate development of the latent images contained in the respective emulsions. The cyan, magenta and yellow dye developers of layers 21, 24 and 27, respectively, are immobilized, as a function of the development of their respective associated silver halide emulsions, preferably substantially as a result of their conversion from the reduced form to their relatively insoluble and nondiffusible oxidized form, thereby providing imagewise distributions of mobile, soluble and diffusible cyan, magenta and yellow dye developer, as a function of the point-to-point degree of their associated emulsions' exposure. At least part of the imagewise distribution of mobile, cyan, magenta and yellow dye developer transfers, by diffusion, through the overcoat layer 40 to aqueous alkaline solution permeable image-receiving layer 41 to provide a multicolor dye transfer image to that layer. In the embodiment shown, subsequent to substantial transfer image formation, a sufficient portion of the ions comprising aqueous alkaline solution 3 transfers, by diffusion, through the aforementioned layers 40 and 41 and through permeable spacer layer 42 to the permeable polymeric acid layer 43, whereupon alkaline solution 3 decreases in pH, as a function of neutralization, to a pH at which the cyan, magenta and and yellow dye developers, in the reduced form, are insoluble and nondiffusible, to provide thereby a stable multicolor dye transfer image.

This image may then be revealed following processing by separation of the image-receiving element from the photosensitive element. When the image-receiving element is manually dissociated from the remainder of the film unit as just described, the thin overcoat layer 40 of the present invention has been found to be extremely useful in facilitating the separation of the image-receiving element from the processing composition by preventing the film-forming polymer of the processing composition from adhering to the image-receiving element during this stripping.

The supports for the respective elements may be opaque or transparent, as desired, and may comprise any of the materials heretofore employed for such a purpose, e.g., paper base materials; ethylene glycol terephthalic acid; vinyl chloride polymers; polyvinyl acetate; polyamides; polymethacrylic acid methyl and ethyl esters; cellulose derivatives such as cellulose acetate, triacetate, nitrate, propionate, butyrate acetate or acetate butyrate; cross-linked polyvinyl alcohol, etc.

As disclosed in, for example U.S. Pat. No. 3,362,819, the polymeric acid neutralizing layer may comprise a nondiffusible acid-reacting reagent adapted to lower the pH from the first (high) pH of the processing composition in which the image dyes are diffusible to a second (lower) pH at which they are not. The acid-reacting reagents are preferably polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. As examples of useful neutralizing layers, in addition to those disclosed in the aforementioned U.S. Pat. No. 3,362,819, mention may be made of those disclosed in the following U.S. patents: Bedell U.S. Pat. No. 3,765,885; Sahatjian et al U.S. Pat. No. 3,819,371; Haas U.S. Pat. No. 3,833,367; Taylor U.S. Pat. No. 3,754,910 and Schlein U.S. Pat. No. 3,756,815.

An inert interlayer or spacer layer may be and is preferably disposed between the polymeric acid layer and the image-receiving layer in order to control the pH reduction so that it is not premature and hence will not interfere with the development process, e.g., to "time" control the pH reduction. Suitable spacer or "timer" layers for this purpose are described with particularity in U.S. Pat. No. 3,362,819 and in others, including U.S. Pat. Nos. 3,419,389; 3,421,893; 3,433,633; 3,455,686, 3,575,701; 3,785,815 and 3,856,522.

The silver halide emulsion layers of the photo-sensitive element preferably comprise optically sensitized silver halide, e.g., silver chloride, bromide or iodide or mixed silver halides such as silver iodobromide or chloroiodobromide dispersed in a suitable colloidal binder such as gelatin and such layers may typically be on the order of 0.6 to 6 microns in thickness. It will be appreciated that the silver halide layers may and in fact generally do contain other adjuncts, e.g., chemical sensitizers such as are disclosed in U.S. Pat. Nos. 1,574,944; 1,623,499; 2,410,689; 2,597,856; 2,597,915; 2,487,850; 2,518,698; 2,521,926; etc.; as well as other additives performing specific desired functions, e.g., coating aids, hardners, fiscosity-increasing agents, stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

Optical sensitization of the emulsion's silver ahlide crystals may be accomplished by contact of the emulsion composition with an effective concentration of optical sensitizing dyes selected to impart sensitivity to the silver halide in predetermined regions of the electromagnetic spectrum, e.g., red, green and blue; all according to the traditional procedures of the art, as described in, for example, Hamer, F.A., *The Cyanine Dyes and Related Compounds*.

The respective dye developers may be any of those heretofore known in the art and disclosed, for example, in U.S. Pat. No. 2,983,606 and numerous other U.S. patents. As examples of U.S. patents detailing specific preferred "metallized" dye developers, mention may also be made of U.S. Pat. Nos. 3,563,739 and 3,551,406 (magenta dye); U.S. Pat. Nos. 3,597,200 and 3,705,184 (yellow dye); and U.S. Pat. No. 3,482,972 (cyan dye). The dye developers are preferably dispersed in an aqueous alkaline solution permeable polymeric binder, e.g., gelatin or a synthetic film-forming polymer such as disclosed in a multiplicity of prior patents, e.g., U.S. Pats. Nos. 2,992,104; 3,043,692; 3,069,203; 3,061,428; 3,044,873; 3,069,264, etc.

The interlayers and auxiliary layer of the photo-sensitive element may comprise an alkaline permeable polymeric material such as gelatin and may be on the order of from about 1 to 5 microns in thickness. As examples of other materials for forming the interlayers, mention may be made of those disclosed in U.S. Pat. Nos. 3,421,892; 3,575,701, 3,615,422; and 3,625,685. These interlayers may also contain additional reagents performing specific functions, e.g., various ingredients necessary for development may be contained initially in such layers in lieu of being present initially in the processing composition.

The liquid processing composition referred to for effecting multicolor diffusion transfer processes comprises at least an aqueous solution of an alkaline material, for example, sodium hydroxide, potassium hydroxide, and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose or sodium carboxymethyl cellulose. Other film-forming materials or thickening agents whose ability to increase viscosity is substantially unaffected if left in solution for a long period of time are also capable of utilization. As stated, the film-forming material is preferably contained in the processing composition in such suitable quantities as to impart to the composition a viscosity in excess of 100 cps. at a temperature of approximately 24° C. and preferably in the order of 10,000 cps. to 100,000 cps. at that temperature.

A rupturable container of known description contains the requisite processing composition and is adapted upon application of pressure to release its contents for development of the exposed film unit, e.g., by distributing the processing composition in a substantially uniform layer between a pair of predetermined layers.

In products employed in the diffusion transfer processes of this invention, it may be preferable to expose from the emulsion side. In such instances, it is, therefore, desirable to hold the photosensitive element and the imagereceiving element together at one end thereof by suitable fastening means in such manner that the photosensitive element and the image-receiving element may be spread apart from their superposed processing position during exposure. A camera apparatus suitable for processing film of the type just mentioned is provided by the Polaroid Land Camera, sold by Polariod Corporation, Cambridge, Massachusetts, or similar camera structure such, for example, as the roll film type camera forming the subject matter of U.S. Pat. No. 2,435,717 or the film pack type camera forming the subject matter of U.S. Pat. No. 2,991,702. Camera apparatus of this type permits successive exposure of individual frames of the photosensitive element from the emulsion side thereof as well as individual processing of an exposed frame by bringing said exposed frame into superposed relation with a predetermined portion of the image-receiving element while drawing these portions of the film assembly between a pair of pressure members which rupture the container associated therewith and effect the spreading of the processing composition released by rupture of said container, between and in contact with the exposed photosensitive frame and the predetermined registered area of the image-receiving element.

The following example is given to illustrate the invention further; however, it should be noted that the invention is not to be interpreted as being limited to the details set forth therein:

EXAMPLE

A series of film units were prepared as follows:

The image-receiving elements were prepared by coating the following layers in succession on a cellulose acetate-butyrate subcoated baryta paper support, said layers respectively comprising the following major ingredients:

1. a mixture of about 8 parts, by weight, of a partial butyl ester of polyethylene/maleic anhydride and about 1 part, by weight, of polyvinyl butyral resin (Butvar, Shawinigan Products, New York, New York) to form a polymeric acid layer approximately 0.6 to 0.9 mils thick;

2. a mixture of about 7 parts, by weight, of hydroxypropyl cellulose (Klucel, J12HB, Hercules, Inc., Wilmington, Delaware), and about 4 parts, by weight, of polyvinyl alcohol; to form a spacer layer approximately 0.30 to 0.37 mils thick; and 3. a mixture of about 2 parts of polyvinyl alcohol and 1 part of poly-4-vinylpyridine to form an image-receiving layer approximately 0.35 to 0.45 mils thick, also containing an equimolar mixture of the cis- and trans isomers of 4,5-cyclopentahexahydropyrimidine-2-thione (described in copending application Ser. No. 214,665, filed Jan. 3, 1972) as a development restraining reagent, and hardened by a condensate of acrolein and formaldehyde.

The photosensitive elements were prepared by coating, in succession, on a gelatin subbed opaque cellulose triacetate film base, the following layers:

1. a layer comprising the cyan dye developer:

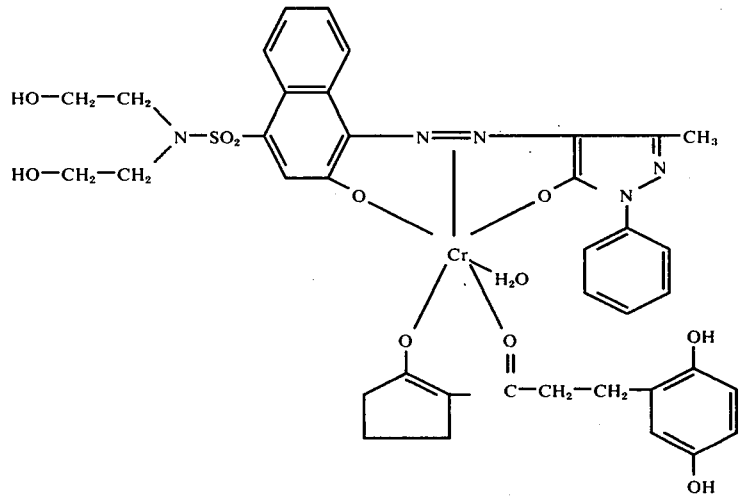

dispersed in gelatin and coated at a coverage of about 69 mgs./ft.$^2$ of dye and about 98 mgs./ft.$^2$ of gelatin;

2. a red-sensitive gelatino silver iodobromide emulsion layer coated at a coverage of about 140 mgs./ft.$^2$ of silver and about 61 mgs./ft.$^2$ of gelatin;

3. an interlayer of a 60-30-4-6 copolymer of butylacrylate, diacetone acrylamide, styrene and methacrylic acid, plus about 2.4% by weight of polyacrylamide permeator, coated at about 180 mgs./ft.$^2$ of total solids;

4. a layer comprising the magenta dye developer;

dispersed in gelatin and coated at a coverage of about 75 mgs./ft.$^2$ of dye and about 66 mgs./ft.$^2$ of gelatin;

5. a green-sensitive gelatino silver iodobromide emulsion layer coated at a coverage of about 80 mgs./ft.$^2$ of silver and about 85 mgs./ft.$^2$ of gelatin;

6. a layer containing the copolymer referred to above in layer 3 plus about 7.8% polyacrylamide coated at about 107 mgs./ft.$^2$ of total solids; and also containing succindialdehyde as a hardener at about 9.8 mgs./ft.$^2$;

7. a layer comprising the yellow dye developer;

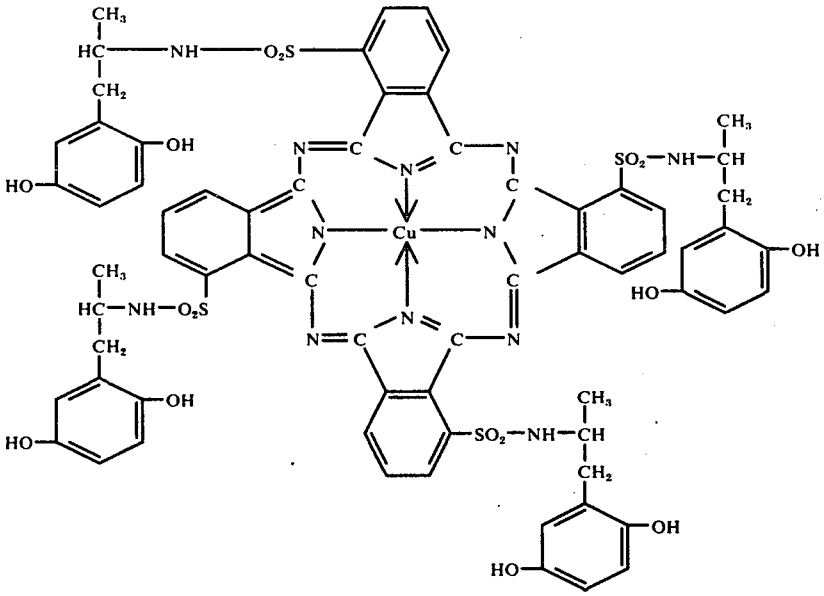

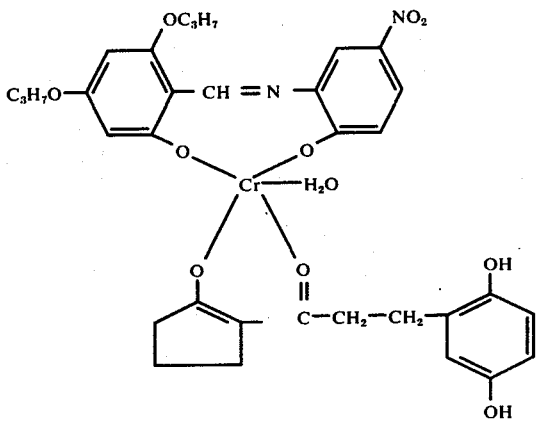

dispersed in gelatin and coated at a coverage of about 83 mgs./ft.$^2$ of dye and about 58 mgs./ft.$^2$ of gelatin;

8. a blue-sensitive gelatino silver iodobromide emulsion layer coated at a coverage of about 120 mgs./ft.$^2$ of silver and about 53 mgs./ft.$^2$ of gelatin, plus about 30 mgs./ft.$^2$ of 4'-methylphenylhydroquinone and 34 mgs./ft.$^2$ of gelatin;

9. a gelatin overcoat layer coated at a coverage of about 40 mgs./ft.$^2$ of gelatin.

A rupturable container comprising an outer layer of lead foil and an inner liner or layer of polyvinyl chloride retaining an aqueous alkaline solution comprising the following basic formulation;

| | | |
|---|---|---|
| Potassium hydroxide (pellets of 85% KOH) | 10.35 | g. |
| Sodium carboxymethyl cellulose (Hercules Type 7H4F) | 3.00 | g. |
| N-phenethyl-α-picolinium bromide | 2.07 | g. |
| Benzotriazole | 3.15 | g. |
| 5-bromo-6-methyl-4-azabenzimidazole | 0.40 | g. |
| 6-methyl uracil | 0.70 | g. |
| Bis-(β-aminoethyl)-sulfide | 0.09 | g. |
| Zinc nitrate | 0.50 | g. |
| Potassium iodide | 0.0018 | g. |
| Lithium nitrate | 0.45 | g. |
| Water | 100 | ml. |

was affixed to the leading edge of the film units such that upon application of compressive pressure to the container, its contents were distributed, upon rupture of the container's marginal seal, between the surface layers of the photosensitive and receiving elements.

One of the above-described film units was maintained unmodified for purposes of control. A second film unit, designated hereinafter as A, was modified by applying to the image-receiving layer thereof an aqueous solution comprising 4.2% by weight of ammonium hydroxide and 0.05% by weight of Triton X-100 (Rohm and Haas Co., Phila., Pa.) at about 1000 mgs. of solution per square foot. A third film unit, B, was treated with the above-mentioned ammonia solution like film unit A and then coated with an aqueous gum arabic solution comprising 2.8% total solids and about 0.05% Triton X-100 so as to form an overcoat layer having a total solids coverage of about 25 mgs./ft.$^2$. Film unit C received the same modifications as film unit B except that the gum arabic overcoat was coated at 25 mgs./ft.$^2$ and then the above-described ammonia solution applied to the overcoat layer at about 1000 mgs./ft.$^2$. Film unit F was modified by applying a gun arabic/ammonia solution in accordance with the present invention at a total solids coverage of about 25 mgs./ft.$^2$. (This solution was prepared by adding the above-described gum arabic solution to the above-described ammonium hydroxide solution. The resulting mixture comprised about 3 parts by weight ammonium hydroxide and 2 parts by weight gum arabic.) Film unit G received the gum arabic/ammonia overcoat just described at a total solids coverage of about 100 mgs./ft.$^2$.

Each film unit was then processed at room temperature (about 75° F.) without exposing the photosensitive element, by spreading the respective processing compositions between the elements as they were brought into superposed relationship between a pair of pressure-applying rollers having a gap of about 0.0044. After an imbibition period of about 2 minutes, the image-receiving element was separated from the remainder of the film unit to reveal a black picture, and the amount of processing composition remaining adhered to the image-receiving element, if any, was noted. About one-half of the picture area of each element was then wiped with mineral oil, and the reflection density to blue light was measured on each half using a densitometer. In each instance, the density was lower on the unoiled portion due to light diffraction, i.e., haze, and the extent of the difference between the density readings from each half, in density units, was taken as a measure of haze for each image-receiving elements, i.e., the greater the difference in densities, the greater the haze reading. Table 1 below summarizes the results obtained for each film unit:

TABLE 1

| Film Unit | Modifications | Processing Composition Adherence Level | Haze Reading (in density units) |
|---|---|---|---|
| Control | unmodified | severe | 0.57 |
| A | $NH_3$ wash only | severe | 0.44 |
| B | $NH_3$ wash, then gum arabic overcoat (25 mgs./ft.$^2$) | none | 0.11 |
| C | $NH_3$ wash, then gum arabic overcoat (100 mgs./ft.$^2$) | slight | 0.16 |
| D | gum arabic overcoat only (25 mgs./ft.$^2$) | none | 0.41 |
| E | gum arabic overcoat (25 mgs./ft.$^2$) then $NH_3$ wash | moderate | 0.35 |

TABLE 1-continued

| Film Unit | Modifications | Processing Composition Adherence Level | Haze Reading (in density units) |
|---|---|---|---|
| F | gum arabic/ammonia overcoat (25 mgs./ft.$^2$) | none | 0.15 |
| G | gum arabic/ammonia overcoat (100 mgs./ft.$^2$) | none | 0.10 |

It can be seen from the results tabulated in Table 1 above that a significant improvement in both the haze reading and separation of elements is effected when the hydrophilic colloid layer is applied subsequent to, or concurrently with, the treatment of the image-receiving layer with the ammonium hydroxide solution. It is also noted that the reduction in haze afforded by the application of the hydrophilic colloid/ammonia overcoat to the image-receiving layer is much greater than the improvement realized by the treatment thereof with ammonia alone, or by coating the hydrophilic layer over the image-receiving layer in the absence of ammonia.

It will be recognized by those skilled in the art that suitable film units may contain less than the described number of layers or may contain one or more additional subcoats or layers, which in turn, may contain one or more additives other than those specifically mentioned.

Since certain changes may be made in the above product and process without departing from the scope of the invention herein involved, it is intended that all matter contained in the above description and examples shall be interpreted as illustrative and not in a limiting sense.

What is claimed is:

1. An image-receiving element for use in a photographic diffusion transfer color process which comprises, in sequence:

a support;

an image-receiving layer comprising polyvinylpyridine on one surface of said support; and an overcoat on said image-receiving layer, said overcoat formed, after drying of said image-receiving layer, by coating said image-receiving layer with an aqueous solution comprising a hydrophilic colloid and ammonia.

2. An element as defined in claim 1 wherein said hydrophilic colloid is gum arabic.

3. An element as defined in claim 1 wherein said solution comprises about 3 parts by weight of ammonium hydroxide and about 2 parts by weight of gum arabic.

4. An element as defined in claim 1 wherein said solution is coated at a coverage of about 5 mgs. to about 100mgs. of total solids per square foot.

5. An element as defined in claim 1 wherein said image-receiving layer comprises poly-4-vinylpyridine and polyvinyl alcohol.

6. A photographic product for forming a diffusion transfer dye image which comprises, in combination:

a photosensitive element comprising a support having coated on one surface thereof, at least one silver halide emulsion layer having associated therewith a dye developer;

an image-receiving element comprising, in sequence, a support, an image-receiving layer comprising polyvinylpyridine, and an overcoat, said overcoat formed by coating said image-receiving layer, after the drying thereof, with an aqueous solution comprising a hydrophilic colloid and ammonia; and means providing an aqueous alkaline processing composition for initiating development of said silver halide emulsion after photoexposure to form thereby an imagewise distribution of mobile dye developer which is transferred, at least in part, to said image-receiving layer to impart thereto a dye image;

said image-receiving element being adapted for separation from contact with said processing composition subsequent to the formation of said dye image.

7. A product as defined in claim 6 wherein said hydrophilic colloid is gum arabic.

8. A product as defined in claim 6 wherein said solution comprises about 3 parts by weight of ammonium hydroxide and about 2 parts by weight of gum arabic.

9. A product as defined in claim 6 wherein said solution is coated at a coverage of about 5 mgs. to about 100 mgs. of total solids per square foot.

10. A product as defined in claim 6 wherein said photosensitive element comprises, coated in sequence on said support, a cyan dye developer layer, a red-sensitive silver halide emulsion layer, a polymeric interlayer, a magenta dye developer layer, a green-sensitive silver halide emulsion layer, a polymeric interlayer, a yellow dye developer layer, a blue-sensitive silver halide emulsion layer, and a polymeric overcoat layer.

11. A product as defined in claim 6 wherein said image-receiving element further comprises a polymeric acid neutralizing layer intermediate said support and said image-receiving layer and a polymeric spacer layer intermediate said neutralizing layer and said receiving layer.

12. A product as defined in claim 6 wherein said image-receiving layer comprises poly-4-vinylpyridine and polyvinyl alcohol.

13. In a process for forming a diffusion transfer dye image wherein an aqueous alkaline processing composition is applied to an exposed photosensitive element which includes a silver halide emulsion having associated therewith a dye developer, thereby effecting development of exposed silver halide, and an imagewise distribution of mobile dye developer is formed which is transferred at least in part, to a superposed image-receiving element having an image-receiving layer comprising polyvinylpyridine, to impart thereto a dye image, and said image-receiving element is separated from contact with said processing composition subsequent to the formation of said dye image, the improvement which comprises:

employing an image-receiving element as defined in claim 1.

14. The method of preparing an image-receiving element for use in color diffusion transfer processes comprising the steps of:

forming an acidic aqueous solution of a polymerized 4-vinylpyridine;

coating said acidic aqueous solution on a support; drying the solution coated on the support with heat to form an image-receiving layer; and thereafter forming an overcoat on said image-receiving layer by coating said image-receiving layer with an aqueous solution comprising a hydrophilic colloid and ammonia.

15. A process as defined in claim 14 wherein said hydrophilic colloid is gum arabic.

16. A process as defined in claim 14 wherein said solution comprises about 3 parts by weight of ammonium hydroxide and about 2 parts by weight of gum arabic.

17. A process as defined in claim 14 wherein said solution is coated at a coverage of about 5 mgs. to about 100 mgs. of total solids per square foot.

* * * * *